US008536519B2

(12) United States Patent
Holle

(10) Patent No.: US 8,536,519 B2
(45) Date of Patent: Sep. 17, 2013

(54) ADJUSTING THE DETECTOR AMPLIFICATION IN MASS SPECTROMETERS

(75) Inventor: Armin Holle, Achim (DE)

(73) Assignee: Bruker Daltonik GmbH, Bremen (DE)

( * ) Notice: Subject to any disclaimer, the term of this patent is extended or adjusted under 35 U.S.C. 154(b) by 355 days.

(21) Appl. No.: 12/389,766

(22) Filed: Feb. 20, 2009

(65) Prior Publication Data

US 2009/0206247 A1 Aug. 20, 2009

(30) Foreign Application Priority Data

Feb. 20, 2008 (DE) ..... 10 2008 010 118

(51) Int. Cl.
*H01J 49/26* (2006.01)

(52) U.S. Cl.
USPC ..... 250/282; 250/281; 250/288; 702/22; 702/23; 702/27; 702/28

(58) Field of Classification Search
USPC ..... 250/281, 282, 283, 288; 702/22, 702/23, 27, 28
See application file for complete search history.

(56) References Cited

U.S. PATENT DOCUMENTS

| | | | | |
|---|---|---|---|---|
| 3,823,315 | A * | 7/1974 | Mosharrafa | 250/283 |
| 4,008,388 | A | 2/1977 | McLafferty et al. | |
| 5,610,396 | A | 3/1997 | Mattern | |
| 6,800,847 | B2 | 10/2004 | Axelsson | |
| 2002/0175292 | A1 * | 11/2002 | Whitehouse et al. | 250/394 |
| 2003/0052264 | A1 * | 3/2003 | Baba et al. | 250/281 |
| 2004/0245451 | A1 * | 12/2004 | Schwartz | 250/282 |
| 2005/0006577 | A1 * | 1/2005 | Fuhrer et al. | 250/287 |

FOREIGN PATENT DOCUMENTS

| | | |
|---|---|---|
| JP | 01166456 | 6/1989 |
| JP | 11213941 | 8/1999 |
| JP | 2000081359 | 3/2000 |
| JP | 2008123767 | 5/2008 |

* cited by examiner

*Primary Examiner* — Nicole Ippolito
(74) *Attorney, Agent, or Firm* — O'Shea Getz P.C.

(57) ABSTRACT

The amplification of secondary-electron multipliers in mass spectrometers is automatically adjusted by generating mass spectra with single ion signals, determining the average value of the peak heights of these single ion signals, and setting the amplification so that the average peak height assumes a desired nominal value. The amplification may be set via the supply voltage of the secondary-electron multiplier and can be increased or decreased by a desired factor using the known characteristic of the secondary-electron multiplier.

11 Claims, 2 Drawing Sheets

ADJUSTING THE DETECTOR AMPLIFICATION IN MASS SPECTROMETERS

PRIORITY INFORMATION

This patent application claims priority from German patent application 10 2008 010 118.4 filed Feb. 20, 2008, which is hereby incorporated by reference.

FIELD OF THE INVENTION

The invention relates to the adjustment of the amplification of secondary-electron multipliers in mass spectrometers.

BACKGROUND OF THE INVENTION

Setting the amplification of a secondary-electron multiplier (SEM) in a mass spectrometer generally presents major difficulties. Most spectrometers can measure neither the quantity of ions generated in the ion source nor the amplification of the SEM on their own, because the two can compensate each other over a wide range. If the signal is too large, it is therefore scarcely possible to determine whether too many ions are being generated or whether the amplification of the SEM is set too high. A high SEM amplification is detrimental, however: on the one hand, it reduces the life of the SEM and, on the other hand, the mass spectrum becomes unnecessarily noisy because too few ions are measured. The problem arises because the amplification of a secondary-electron multiplier does not remain constant over its lifetime but is always changing when in use as a result of aging processes. These changes can be continuous, but can also occur in steps of various sizes.

The nature of the problem is explained here using the examples of two completely different mass spectrometers: RF ion trap mass spectrometers as invented by Wolfgang Paul, which mostly use channeltron detectors, and MALDI time-of-flight mass spectrometers, which mainly use multichannel plates as secondary-electron multipliers. The type of SEM is not relevant here. The problem lies in the fact that the rate of ion generation in the ion source or the filling of ion traps and the amplification of the SEM compensate each other in such a way that the SEM amplification cannot be determined on its own. The mass spectrometers do not usually have any other types of measurement devices for ion currents with which the amplification of the secondary-electron multiplier can be determined.

In a MALDI time-of-flight mass spectrometer the ions are generated from solid samples with ionization by matrix-assisted laser desorption. The samples are dried onto a sample support plate and include a mixture of matrix material, usually an easily vaporized organic acid, with very few analyte molecules, which are to be investigated. Bombarding the samples with laser light pulses of a suitable wavelength and suitable pulse duration leads to the generation of a small plasma cloud, in which sufficient ions of the analyte substance are formed in addition to many ions of the matrix substance.

The number of ions generated per laser shot can be varied over wide ranges of several orders of magnitude by changing the laser energy, but only laser energies in a narrow range produce sufficient analyte ions which are relatively stable, i.e., not rapidly decomposing. Analyses with reliable results can only be carried out in this narrow range. The optimum laser energy, on the other hand, depends on the type of matrix material. The laser energy is usually adjusted by measuring the ion current, which includes mainly matrix ions. However, this ion current measurement depends on the multiplier amplification. If the multiplier operation would be always constant and the multiplier would show no signs of aging, its amplification could be set just once at the factory and this would allow the optimum laser energy to always be set during the whole life time of the multiplier. But the secondary-electron multipliers do age, and this is a problem.

A similar problem occurs with ion trap mass spectrometers. In this case it is not the quantity of ions generated but the process of filling the ion trap with ions that is controlled via the ion current at the SEM detector. This filling is critical because even a slight overfill reduces the quality of the mass spectrum, especially the quality of its mass resolving power. The overfill does not simply depend on the number of ions in the ion trap, but is also dependent on the distribution of the ions across the different masses. The filling is therefore controlled by analyzing the preceding mass spectrum, where the numbers of ions for the individual ionic species should be known as accurately as possible. The numbers of ions are again determined using the ion current at the SEM detector. Here, also, interference is caused by the aging of the secondary-electron multiplier because as the amplification decreases, these numbers of ions cannot be determined accurately without resetting the amplification of the SEM.

There are several types of secondary-electron multiplier (SEM, often called "multiplier" for short). In the oldest type, which is still in use, the secondary-electron multiplier includes discrete dynodes, between which voltages in the order of 100 to 200 volts per pair of dynodes are applied by a voltage divider. Secondary-electron multipliers exist with between 8 and 18 dynodes. The ions impinge on the first dynode, thus generating secondary electrons, which are accelerated and then impinge onto the second dynode. Each of these electrons then generates, on average, several secondary electrons so that an avalanche of electrons forms along the dynodes. The amplification is the number of electrons from the last dynode per ion which impinges onto the first dynode. The amplification of commercially available multipliers can be adjusted over a wide range, in the extreme case between $10^4$ and $10^8$, by changing the total voltage, although operating the multiplier at the highest voltages generally leads to very rapid aging.

Other types of secondary-electron multipliers are the so-called "channeltron multipliers" and the "multichannel plates". The channeltron multiplier includes of a single channel with an opening in the form of a trumpet, the channel bent to a kind of spiral. The multichannel plate is usually supplied in a design that includes two plates, each including millions of parallel channels, one behind the other with channel directions at a slight angle to each other (chevron arrangement). In both these types of secondary-electron multiplier, voltage drops exist across the internal surface of the channels which, given an appropriate shape and surface conditioning, lead to electron avalanches in the channels. The amplification ranges are similar to those of dynode secondary-electron multipliers. FIG. 1 shows the characteristic for a double multichannel plate with channels only two micrometers in diameter.

The secondary-electron multipliers have characteristics displaying the logarithm of the amplification as a function of the supply voltage. The characteristics are more or less straight, i.e., an increase in the supply voltage by a value $\Delta V$ increases the amplification by a factor F. Aging changes the position of the characteristic, but its gradient stays approximately the same. A decrease in the amplification by a factor F as a result of aging can therefore be compensated again to a certain extent by increasing the voltage by a voltage difference ΔV.

It is an unfortunate fact that the amplification of all secondary-electron multipliers deteriorates during their service life. This aging does not simply depend on time, but on the duration of use, the type and energy of the ions which generate the first generation of electrons, and further parameters such as temperature, resting periods, type of residual gas in the vacuum, venting periods, et cetera. Their amplification, which depends on the voltage applied, must therefore be occasionally readjusted by adjusting this voltage. There is a need for an automated adjustment procedure that is run regularly in the mass spectrometer.

SUMMARY OF THE INVENTION

An aspect of the invention includes generating mass spectra with recognizable single ion signals, determining the average value of the peak heights of these single ion signals, and setting the amplification of the secondary-electron multiplier so that a desired average value of the peak heights is obtained.

For the acquisition of a mass spectrum with single ion signals it is necessary to reduce the ion generation in the ion source or the filling of the ion trap and to detune the mass spectro-meter so that many peaks appear in the mass spectrum, each originating from one single ion only. Their signals should preferably not overlap too much. It is not essential for the mass spectrum to include only such single ion signals, but they must be clearly recognizable. Single ion signals can usually be identified by their characteristic full width at half maximum (FWHM).

The peak heights of single ion peaks vary greatly because when the ions impinge onto the SEM, they can generate between zero and six or more secondary electrons—showing a Poisson distribution—and their peak heights can therefore vary by corresponding factors of one to six. For a good determination of the averages of the peak heights, at least thirty single ion peaks should be evaluated; recommendable are one hundred to several hundreds of peaks. In order to determine the average peak height sufficiently well and to not inadvertently neglect smaller peaks, it may be necessary to increase the amplification sufficiently before determining the peak heights of the single ion signals. If not enough single ion peaks are present in such a mass spectrum, several such mass spectra can be acquired and used to determine the average.

The specified amplification of the SEM can either be adjusted so that the specified nominal average peak height is obtained in several adjustment attempts with measurements of new mass spectra; it is, however, easier to carry out the adjustment via the known characteristic of the SEM, which gives the relationship between a voltage change and the corresponding change factor for the amplification. If a very small average of the peak heights is to be achieved as nominal value, the use of the characteristic is unavoidable because, in this case, the resulting peak height distribution can no longer be measured directly.

The mass spectrum is acquired in the usual way, amplified by the SEM and electronic amplifiers, digitized and digitally stored. In this digitized mass spectrum, the single ion signals can be easily recognized by their peak widths using a suitable computer program, and investigated for their peak height. Convenient computer programs for the control of the mass spectrometers can be developed comprising program parts that automatically reduce the ion current of the ion source, detune the mass spectrometer, acquire mass spectra with single ions, compute the average peak heights from a prespecified number of peaks, and automatically adjust the multiplier voltage and thereby its amplification, the latter preferably by knowledge of the gradient of the SEM's characteristic.

These and other objects, features and advantages of the present invention will become more apparent in light of the following detailed description of preferred embodiments thereof, as illustrated in the accompanying drawings.

DETAILED DESCRIPTION

Figure 1:
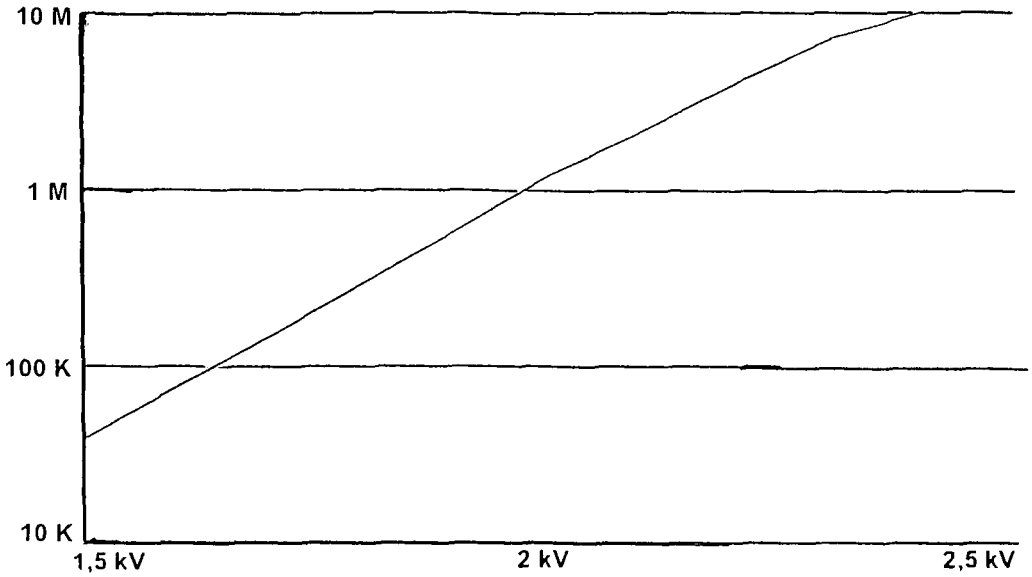
FIG. 1 shows the characteristic of a conventional multichannel plate that includes two plates with fine channels (e.g., two micrometers in diameter) in a chevron arrangement. The amplification range is somewhat limited due to the fine channels size, but even here is between $4\times10^4$ and 1inc$1\times10^7$.
Figure 2:
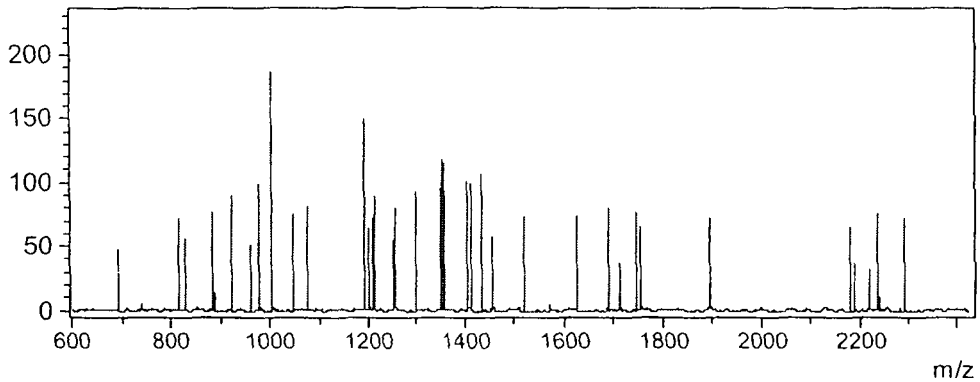
FIGS. 2 and 3 show sections of a mass spectrum which has been obtained with a single laser bombardment in a MALDI time-of-flight mass spectrometer and includes essentially of single ion peaks. The variation of the peak heights is large and is caused by the yield of secondary electrons when the ions impinge, which amounts to between zero and six secondary electrons. The mass of the ions corresponds approximately to the mass shown on the mass scale below the spectrum; it is therefore possible here to set the amplification using ions of selected mass ranges.
Figure 3:
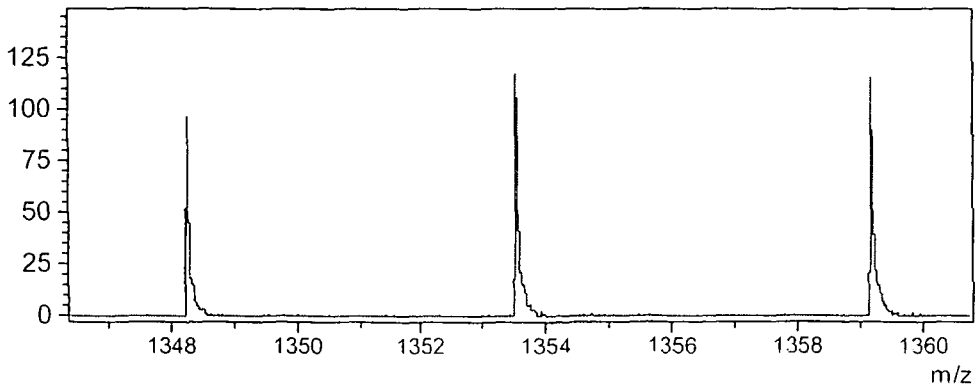

A method for reproducibly adjusting the amplification of a secondary-electron multiplier in a mass spectrometer includes (a) acquiring a mass spectrum with single ion signals; (b) calculating the average peak height of the single ion signals; and (c) adjusting the supply voltage of the secondary-electron multiplier so that a desired nominal value for the average peak height is obtained.

In order to obtain mass spectra with a sufficient number of single ion signals, it is expedient to detune the temporal and/or spatial focusing of the mass spectrometer so that its resolution becomes extremely bad and the normally well-resolved ion signals for ions of the same mass change to a broad overlapping mixture. Moreover, the number of ions reaching the detector in any mass spectrometer can be greatly reduced until predominantly only single ion signals with no overlapping appear in the mass spectrum. This can be achieved by restricting the generation rate of the ions in the ion source, for example, or by restricting the ion transmission through the mass spectrometer. In mass spectrometers which operate with ion traps or temporary stores, the filling quantities can be greatly reduced. The peak heights of single ion signals should be well recognizable above the electronic background noise; if this is not the case, the voltage at the multiplier should be increased. All these measures serve to reduce the mass spectrum to signals which are, on one hand, significantly above the electronic background noise and can be recognized, and on the other hand, as single ions. In most cases, it is irrelevant whether these single ion signals originate from ions from the conventional chemical noise background or from analyte ions.

It is not essential that the mass spectrum does not contain any signals from ion accumulations. Single ion signals can be easily recognized and selected by their width at half peak height.

It can be advantageous to operate the mass spectrometer in such a way that single ion signals are so small that at least the statistically small signals are no longer visible after digitization. If this makes the peak heights too small for the average peak heights to be determined, for example if they count only a few counts of the analog-to-digital converter (ADC), they can be increased to a height that can be readily analyzed in a repeat scan by increasing the voltage across the SEM by an increase factor for the amplification. The known characteristic of the amplification as a function of the SEM voltage is therefore used here for the first time.

If an eight-bit digital converter is used, for example, having an output range of zero to 256 counts, it is then favorable if the single ion peak heights range from around 10 to 50 counts, or even better from 20 to 100 counts. However, care has to be taken that signals from ion accumulations do not drive the SEM and its amplification electronics hopelessly into saturation, because such a saturation may suddenly change the amplification of the SEM, permanently or even only temporarily.

A sufficient number of single ion peaks in this single ion spectrum is then evaluated to determine the average height of the single ion peaks and to compare it with its nominal value. The SEM amplification is then adjusted to the desired value for the average height of the single ion peaks, using the characteristic again, if necessary. This average height can, for example, be at five counts of the analog-to-digital converter (ADC), or at only half a count, so that with this setting, weak single ion peaks would not be identifiable at all after being digitized, but nevertheless a good mass spectrum can be measured because often the only ion peaks which are of interest are those where at least ten ions occur together. The desired setting for the average peak height of the single ion peaks therefore depends on the required dynamic range of measurement and the bit range and resolution of the ADC.

The average value can be a linear average, a logarithmic average or an otherwise defined average value.

Only when the amplification of the secondary-electron multiplier is adjusted to its nominal value is it possible to correctly carry out other adjustments of the mass spectrometer, such as setting the laser energy for MALDI or filling an ion trap.

It is advantageous for the method if the SEM characteristic, which is the function of the logarithm of the amplification on the operating voltage of the SEM, is known. This characteristic is usually measured at the mass spectrometer factory or even delivered by the SEM manufacturer. The SEM characteristic is, of course, also subject to aging, but the slope of the characteristic changes only little. The slope of the characteristic can, however, also be checked and corrected by using the average heights of the single ion peaks.

In an RF ion trap mass spectrometer, there are several methods of producing a mass spectrum includes mainly single ion signals, and they are known. The simplest method is to switch off the RF voltage of the ion trap completely or to a large extent so that the injected ions can fly through the ion trap, and to decrease the ion generation of the ion source to such an extent that only a weak beam of ions flies through the ion trap. Then a mass spectrum is acquired for a certain period of time, which does not, of course, produce a mass-resolved spectrum but simply a single ion spectrum with ions of statistically distributed masses. The masses of the ions depend on the mixture of substances which are ionized in the ion source.

The ion trap can also be filled with ions in the normal way, however; and a selected ionic species can be smear ejected over a long period of several hundred microseconds by cautious resonant excitation of the ions to secular oscillations. It is preferable if a low RF storage voltage is chosen to avoid fragmentation of the ions. This second way of scanning mass spectra with single ion peaks allows the amplification of the secondary-electron multiplier to be tuned to one selected ionic species. The amplification of any secondary-electron multiplier depends mainly on the energy of the ions and to a minor degree on the type and mass of the ions to be detected. In ion trap mass spectrometers, the kinetic energy of the ions is determined by the design of the ion trap and the power supply in the detector area. It should be noted that in many types of ion trap mass spectrometers the ions are not shot directly onto the secondary-electron multiplier, but first impinge onto a conversion dynode, which converts the impinging ions into secondary electrons. These secondary electrons are then accelerated toward the secondary-electron multiplier. The latter is usually designed as a Channeltron multiplier. This two-stage operation is favorable for the detection of both positive and negative ions, but does not change the necessity to occasionally adjust the amplification. In this case, the amplification adjustment of the SEM includes the conversion dynode.

The scanning method for mass spectra with single ion peaks in a MALDI time-of-flight mass spectrometer is even simpler. In this case, the voltage across the first acceleration region in the ion source can be made very small, resulting in a drastic decrease in the mass resolution of the spectrometer. With single laser shots, one can then obtain single ion spectra, and the density of the ion peaks in the spectrum can be adjusted as desired by the energy in the laser shot. By increasing the supply voltage at the secondary-electron multiplier, the peak heights can be adjusted so that, on the one hand, no low peaks are missed and, on the other hand, no peaks cause the analog-to-digital converter to saturate. In this case, the single ions have masses that roughly correspond to their position in the mass spectrum. Here too, therefore, it is possible to adjust the amplification with ions of a specific mass, if required, by scanning many individual mass spectra.

The adjustment procedure can be fully automated, using the computer/controller of the mass spectrometer and its control programs. The computer can automatically control the reduction of the ion current of the ion source and detune the mass spectrometer. Single ion mass spectra are acquired in the usual way, amplified by the SEM and electronic amplifiers, digitized and digitally stored. In this digitized mass spectrum, the single ion signals can be easily recognized by their peak widths using suitable computer program parts, and investigated for their peak height. The computer then automatically adjusts the multiplier voltage and thereby its amplification, the latter preferably by knowledge of the gradient of the SEM's characteristic.

Figure 4:
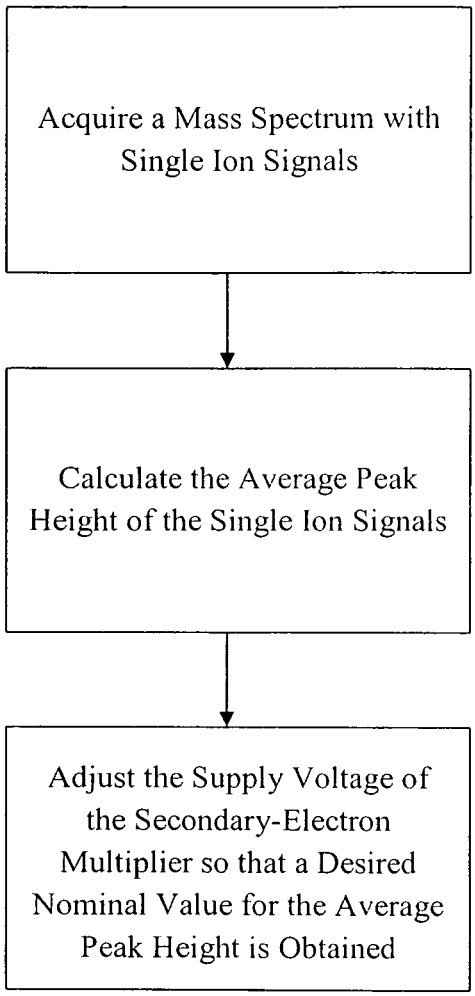
FIG. 4 is a flow chart illustration of an automated process for adjusting the detector amplification in mass spectrometers.

FIG. 4 is a flow chart illustration of an automated process for adjusting the detector amplification in mass spectrometers performed by the mass spectrometer computer/controller.

Although the present invention has been illustrated and described with respect to several preferred embodiments thereof, various changes, omissions and additions to the form and detail thereof, may be made therein, without departing from the spirit and scope of the invention.

What is claimed is:

1. A method for adjusting the amplification of a secondary-electron multiplier in a mass spectrometer, the method being performed between analytical measurements of the mass spectrometer, comprising:

acquiring a mass spectrum with single-ion signals;

calculating an average peak height of the single-ion signals in the acquired mass spectrum; and adjusting the supply voltage of the secondary-electron multiplier so that a desired nominal value for the average peak height is obtained.

2. The method of claim 1, wherein a characteristic of the secondary-electron multiplier, representing the amplification as a function of supply voltage, is used during the adjusting of the supply voltage.

3. The method of claim 1, further comprising prior to the acquiring a mass spectrum with single-ion signals, increasing the supply voltage of the secondary-electron multiplier to obtain peak heights of the single-ion signals recognizable above the electronic background noise for adjusting the supply voltage.

4. The method of claim 1, wherein at least thirty single ion signals are used for the calculating of the average peak height of the single-ion signals.

5. The method of claim 1, wherein the generation rate for ions in the ion source of the mass spectrometer is reduced for the acquisition of a mass spectrum with single-ion signals.

6. The method according of claim 1, wherein the spatial and/or temporal focusing of the ions in the mass spectrometer is detuned for the acquisition of a mass spectrum with single-ion signals.

7. The method according of claim 1, wherein the transmission of ions in the mass spectrometer is reduced for the acquisition of a mass spectrum with single-ion signals.

8. The method of claim 1, wherein a controller for the mass spectrometer automatically reduces the ion current of the ion source, detunes the mass spectrometer, acquires mass spectra with single-ion peaks, computes the average peak height of the single-ion peaks, and adjusts the voltage of the secondary electron multiplier to such a value that a desired nominal average peak height value is obtained.

9. A method for adjusting the amplification of a secondary-electron multiplier in a mass spectrometer, the method being performed between analytical measurements of the mass spectrometer, comprising:

acquiring a mass spectrum with single-ion signals;

calculating an average peak height of the single-ion signals in the acquired mass spectrum; and adjusting the supply voltage of the secondary-electron multiplier so that a desired nominal value for the average peak height is obtained, wherein the generation rate for ions in the ion source of the mass spectrometer is reduced for the acquisition of the mass spectrum with single-ion signals.

10. A method for adjusting the amplification of a secondary-electron multiplier in a mass spectrometer, the method being performed between analytical measurements of the mass spectrometer, comprising:

acquiring a mass spectrum with single-ion signals;

calculating an average peak height of the single-ion signals in the acquired mass spectrum; and adjusting the supply voltage of the secondary-electron multiplier so that a desired nominal value for the average peak height is obtained, wherein at least one of the spatial focusing and temporal focusing of the ions in the mass spectrometer is detuned for the acquisition of the mass spectrum with the single-ion signals.

11. A method for adjusting the amplification of a secondary-electron multiplier in a mass spectrometer, the method being performed between analytical measurements of the mass spectrometer, comprising:

acquiring a mass spectrum with single-ion signals;

calculating an average peak height of the single-ion signals in the acquired mass spectrum; and adjusting the supply voltage of the secondary-electron multiplier so that a desired nominal value for the average peak height is obtained, wherein the transmission of ions in the mass spectrometer is reduced for the acquisition of the mass spectrum with single-ion signals.

* * * * *